United States Patent [19]

Mendelsohn

[11] 4,161,900

[45] Jul. 24, 1979

[54] VENEER EDGING JIG FOR TABLE SAWS

[76] Inventor: Jeffrey G. Mendelsohn, 11816 W. 99th Pl., Overland Park, Kans. 66214

[21] Appl. No.: 874,855

[22] Filed: Feb. 3, 1978

[51] Int. Cl.[2] ..... B27B 5/04

[52] U.S. Cl. ..... 83/409; 83/435.1; 83/464; 83/477.2

[58] Field of Search ..... 83/409, 435.1, 437, 83/422, 477.2, 475, 464, 465, 466.1

[56] References Cited

U.S. PATENT DOCUMENTS

| | | | |
|---|---|---|---|
| 292,309 | 1/1884 | Henderson | 83/435.1 |
| 586,695 | 7/1897 | Saxton | 83/409 |
| 726,403 | 4/1903 | Calhoun et al. | 83/409 |
| 1,784,028 | 12/1930 | Pollard | 83/409 X |
| 1,831,124 | 11/1931 | Koster | 83/435.1 |
| 2,289,142 | 7/1942 | Parsons | 83/465 X |
| 2,655,959 | 10/1953 | Krueger et al. | 83/409 |

*Primary Examiner*—Frank T. Yost
*Attorney, Agent, or Firm*—John A. Hamilton

[57] ABSTRACT

A veneer edging jig for a table saw having a flat table with a vertical circular saw blade projecting upwardly through a slot thereof, and a groove parallel to the plane of the saw blade, the jig consisting of elongated upper and lower clamp plates adapted to grip a stack of veneer sheets therebetween with edges of the sheets to be trimmed projecting beyond a matching pair of longitudinal edges of the plates, and a rib carried by the lower plate and engageable in the table groove so that the plates may be moved over the table with its matching edges flush with the saw blade, and the projecting portions of the veneer sheets are accurately cut away.

4 Claims, 6 Drawing Figures

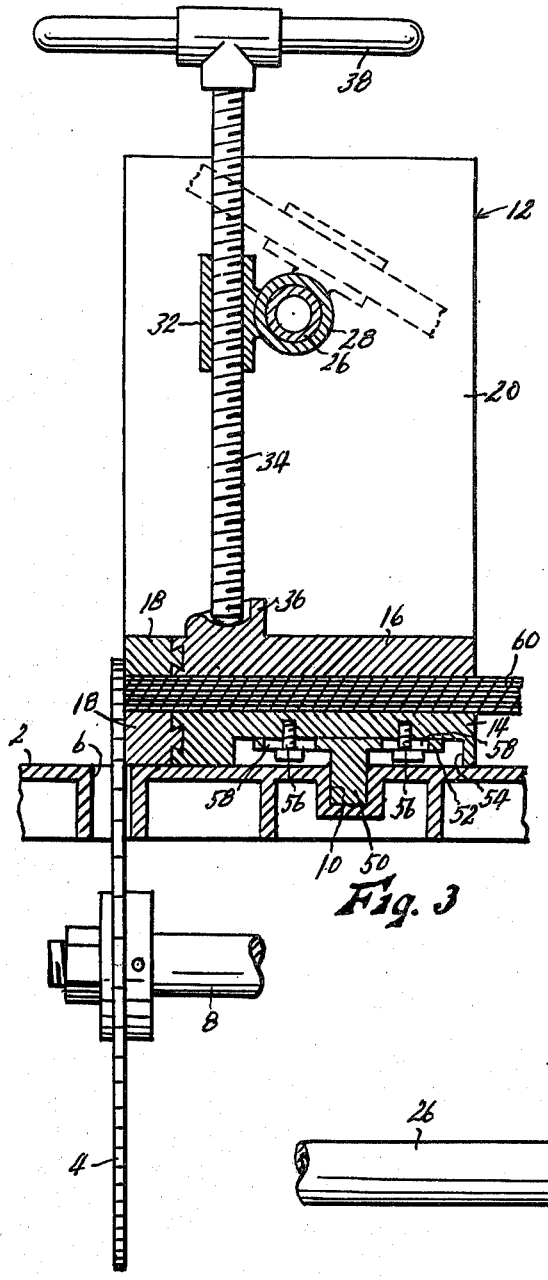
Fig. 3
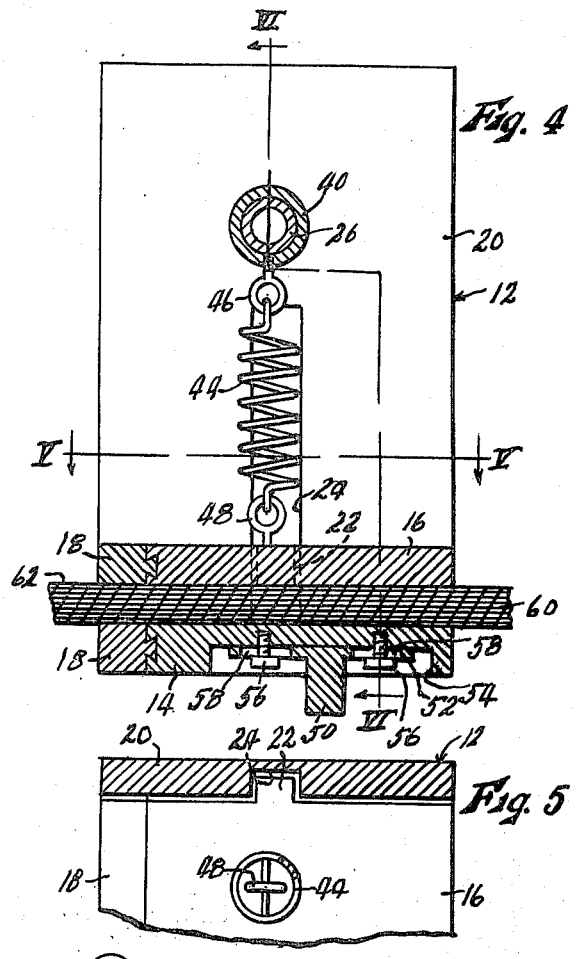
Fig. 4
Fig. 5
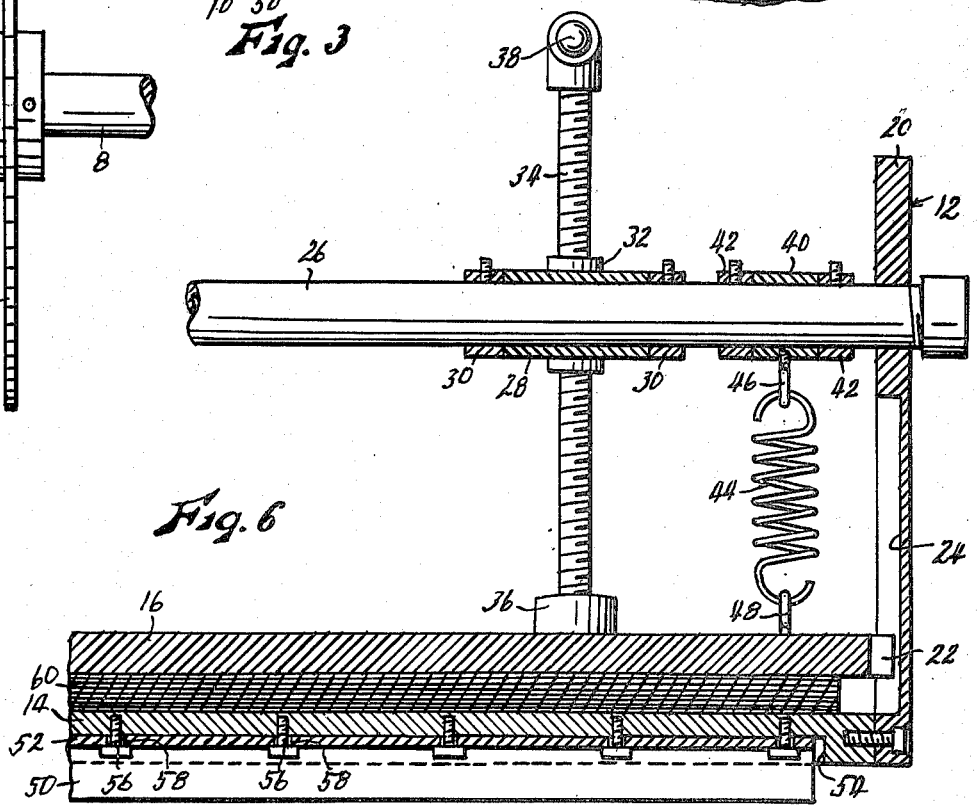
Fig. 6

VENEER EDGING JIG FOR TABLE SAWS

This invention relates to new and useful improvements in devices for edging sheets of wood veneer, and has particular reference to a device operable to permit the performance of this operation by the use of an ordinary table saw.

Wood veneer sheets are of course quite thin, perhaps as little as one-one hundreth of an inch, and due to their manner of production are wavy in form and have uneven edges. On the other hand, for actual use, before they are applied to the base wood, they must be pressed flat, and their edges dressed accurately to a straight line, with no breakage, splintering, cracking, or other damage to the wood immediately adjacent the dressed edge. This accurate edging is particularly necessary, of course, where a plurality of veneer sheets are to be applied to the same base wood surface in abutting relation, as to form a "quartering" pattern of the wood grain of the veneer. It is difficult to cut extremely thin sheets of wood without causing one or more of the types of damage enumerated hereinabove.

Heretofore the edging of veneer sheets has required the use of relatively complicated clamps, cutting tools and other equipment. It is the object of the present invention to provide means whereby a large number of veneer sheets may be edged very rapidly, easily and accurately, with no damage to the wood adjacent the cut edge.

Another object is the provision of a device of the character describing consisting of a special jig for clamping the veneer sheets, and adapted to be moved in guided relation to the blade of an ordinary table saw, which performs the actual edging operation.

Further objects are the provision of a device of the character described having special provisions allowing adjustment of the jig to different table saws, and very rapid and easy clamping and unclamping of the veneer sheets.

Figure 1:
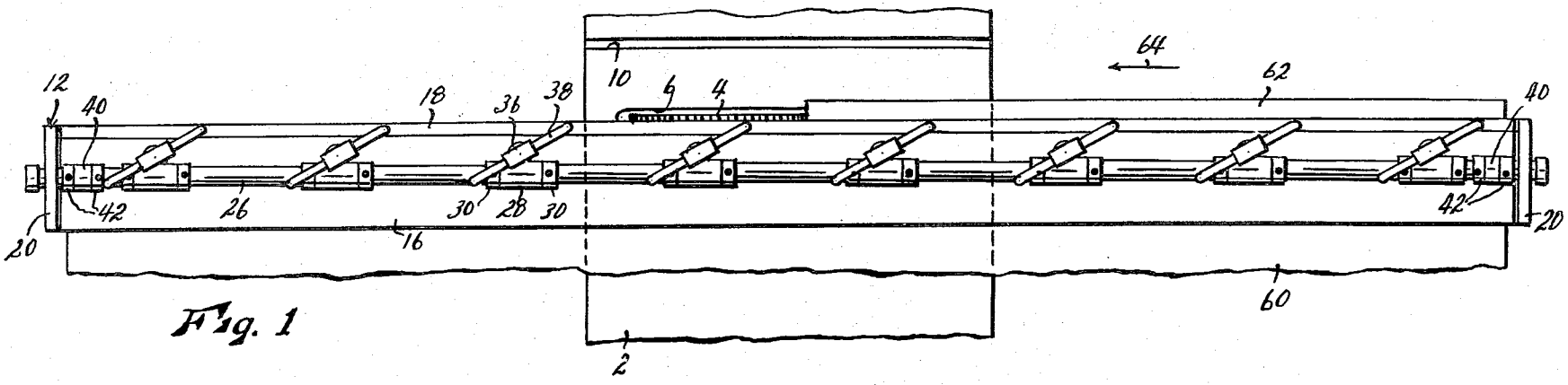
Figure 2:
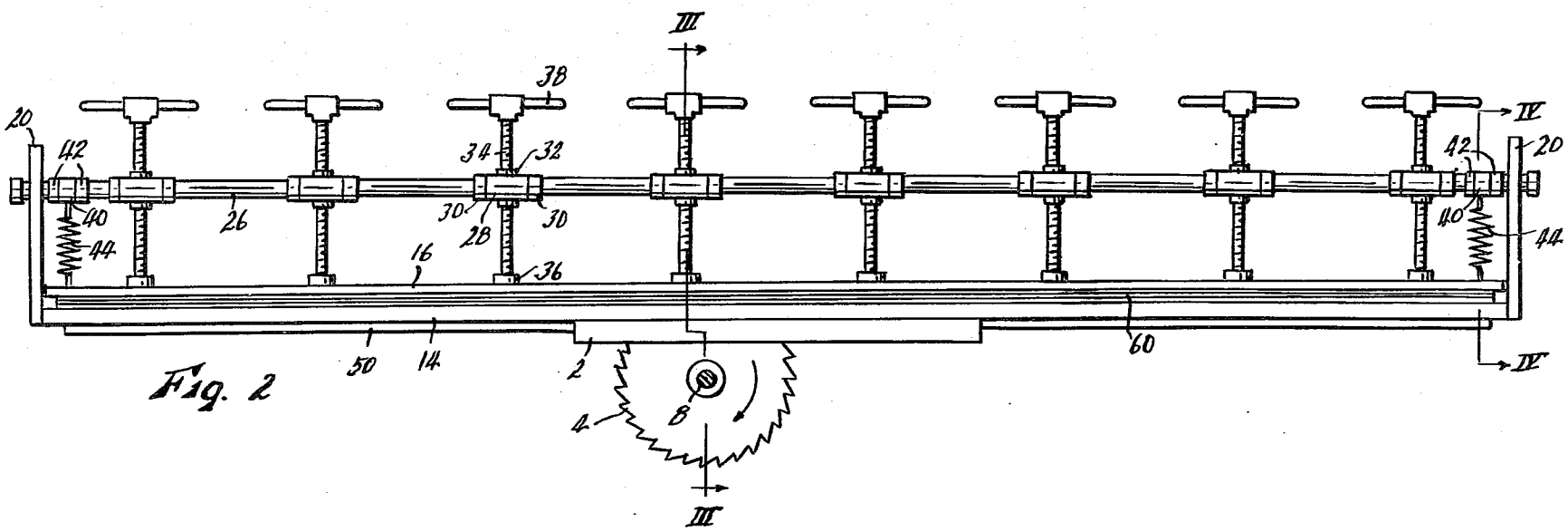

With these objects in view, as well as other objects which will appear in the course of the specification, reference will be had to the accompanying drawing, wherein:

FIG. 1 is a top plan view of a veneer edging jig, embodying the present invention, in which a number of wood veneer sheets are clamped, and shown in operative relation to a fragmentarily illustrated table saw, FIG. 2 is a side elevational view of the structure as shown in FIG. 1, FIG. 3 is an enlarged, fragmentary sectional view taken on line III—III of FIG. 2, FIG. 4 is an enlarged, fragmentary sectional view taken generally on line IV—IV of FIG. 2, FIG. 5 is a fragmentary sectional view taken on line V—V of FIG. 4, and FIG. 6 is a fragmentary sectional view taken on line VI—VI of FIG. 4.

Like reference numerals apply to similar parts throughout the several views. The numeral 2 applies to the fragmentarily illustrated table of an ordinary table saw. The upper surface of said table is planar, and has a planar circular saw blade 4, disposed in a vertical plane, with its upper portion projecting upwardly through and above a slot 6 formed therethrough. Said blade is fixed concentrically on a horizontal shaft 8 disposed beneath the table and rotatably driven by a suitable power unit, not shown, forming an element of the table saw. Most table saw tables have a groove 10 formed in the upper surface thereof, see FIG. 3, extending the full length of the table and being parallel to slot 6, and hence parallel to the plane of blade 4. Said groove is provided, at either or both sides of slot 6, to assist in guiding work pieces in relation to the blade. Other structural details of the table saw are not pertinent to the present invention.

The veneer edging jig forming the subject matter of the present invention is indicated generally by the numeral 12, and includes a lower clamp plate 14 and an upper clamp plate 16. Said clamp plates are horizontally flat, at least a few inches wide, and perhaps eight feet long, much longer than the table of the usual table saw. The long length is desirable in order to enable the jig to receive veneer sheets of maximum length.

The plates are preferably formed of metal, for strength and rigidity, but a matching pair of longitudinal edges thereof, which as will appear may come into direct contact with saw blade 4, are formed of hard wood strips 18 or other relatively soft material to prevent damage to the blade. Strips 18 are dove-tailed to the body portions of the plates, and may be replaced when they become worn or damaged. Their free edges are disposed accurately in the same vertical plane.

A rigid upright 20 is affixed to each end of lower plate 14, and projects upwardly therefrom. The ends of upper plate 16 engage for vertical sliding movement between said uprights, and a longitudinally extending tongue 22 (see FIGS. 4–6) at each end of the upper plate engages slidably in a vertical groove 24 formed in the adjacent upright, whereby the upper plate is maintained in transverse alignment with the lower plate at all times.

Uprights 20 extend well above top plate 16, and a heavy-walled pipe or rod 26, spaced above and parallel to the clamp plates, extends the full length of the jig and is mounted adjacent its ends in uprights 20. A series of sleeves 28 are rotatably mounted on said pipe at regularly spaced intervals therealong, each sleeve being prevented from moving axially along the pipe by a pair of collars 30 fixed on the pipe adjacent thereto. A nut 32 is affixed tangentially to each sleeve 28, as by welding, with the nut axis at right angles to pipe 26. A heavy screw 34 is threaded in each nut 32, extending axially in both directions therefrom. By turning its sleeve 28 on pipe 26, each screw 34 may be disposed vertically, its lower end engaging in a shallow socket member 36 fixed to or formed integrally with the top surface of upper clamp plate 16, and provided at its upper end with a T-handle 38 whereby the screw may be turned manually. Adjacent each end of pipe 26, another sleeve 40 is rotatably mounted thereon and secured against axial movement by collars 42. A vertical tension spring 44 is engaged at its upper end in an eye 46 fixed in sleeve 40, and at its lower end in an eye 48 fixed in the upper surface of upper clamp plate 16. Said springs are of sufficient strength to elevate plate 16 whenever it is not held down by screws 34.

Lower clamp plate 14 is provided, on its lower surface, with a depending rib 50 extending longitudinally thereof for substantially its entire length, said rib being adapted to engage snugly but slidably in a groove 10 of saw table 2. As best shown in FIGS. 3, 4 and 6, said rib is provided with a continuous T-head 52 disposed in a recess 54 formed in the lower surface of plate 14, and said T-head is fixed to said plate by screws 56 disposed at spaced intervals therealong, at both sides of rib 50, said screws extending through slots 58 of the T-head which are elongated transversely of the rib.

In operation, screws 56 are first loosened, and rib 50 adjusted transversely to precise parallelism with the longitudinal edge of plate 14 carrying wood strip 18, and at such a transverse distance therefrom that when said rib is engaged in groove 10 of the saw table, wood strip 18 will extend flush with the adjacent face of saw blade 4. This spacing varies in different models of table saws. Screws 56 are then re-tightened. Then, preferably with the jig removed from the saw table, screws 34 are retracted upwardly sufficiently to free their lower ends from sockets 36, then pivoted out of the way by turning their sleeves 28 on pipe 26, as indicated in dotted lines in FIG. 3, whereupon upper clamp plate 16 is elevated well above lower plate 14 by springs 44. This permits rapid and easy insertion of the veneer sheets. A number of veneer sheets 60, disposed in stacked relation, may then be inserted between the clamp plates, with the edge portions 62 thereof to be trimmed away extending outwardly beyond the edges of the clamp plates having the wooden edge strips 18, as indicated in FIGS. 1 and 4. Screws 34 are then again pivoted to vertical, their lower ends re-engaged in sockets 36, and tightened by turning T-handles 38 to clamp the veneer sheets firmly between the clamp plates.

The jig is then reapplied to the saw table, with rib 50 engaging in groove 10 of the table, and with saw blade 4 turning operably, is moved along the table, with rib 50 sliding through groove 10, in the direction of arrows 64 in FIG. 1.

In this manner, the edge portion 62 of the veneer sheets projecting outwardly from plate edges 18 is cut away easily, rapidly and with a high degree of accuracy. The cut line will be as straight as it is possible to make the clamp plates and rib of the jig. Any horizontal flexing of the jig, due to its great length and projection beyond the limits of the saw table, will not affect this accuracy, since the point of cutting of the veneer at any given moment is aligned with a portion of rib 50 positively guided by table groove 10. The motion of the jig across the saw table should be as smooth and continuous as possible, in order to avoid small irregularities, or "hesitation marks", in the sawed edges. Any warping or bowing of the veneer sheets, which could effect the straightness of their sawed edges if they were sawed in this form and later applied to base wood, is eliminated by their being pressed flat between the clamp plates. Also, the veneer sheets are firmly clamped between the plates all the way to the plane of the saw cut, as closely as it is possible to set rib 50 to provide this condition. This eliminates the shattering, splintering, splitting or other damage to the sheet edges which might otherwise occur if the saw cut were spaced apart from the adjacent edges of the clamp plates. In fact, to insure against edge damage to the veneer sheets to the greatest possible degree, rib 50 may be intentionally so set that the saw blade actually cuts into wooden edge strips 18 of the clamp plates at the same time it edges the veneer sheets. Of course, if this is done, strips 18 are gradually cut away, whereupon they may be replaced with new strips.

While I have shown and described a specific embodiment of my invention, it will be readily apparent that many minor changes of structure and operation could be made without departing from the spirit of the invention.

What I claim as new and desired to protect by Letters Patent is:

1. For use in combination with a table saw having a horizontal planar table and a power driven circular saw blade disposed in a vertical plane with its upper portion projecting upwardly through and above a slot of said table, a veneer edging jig comprising:

a. an elongated lower clamp plate adapted to rest slidably on said saw table, b. an elongated upper clamp plate disposed above and parallel to said lower plate, c. operating means operable to lower said upper plate forcibly toward said lower plate whereby to clamp veneer sheets therebetween with the portions of said sheets to be trimmed away projecting outwardly between a pair of matching longitudinal edges of said plates, the longitudinal edge portions of said plates, at said matching edges thereof, being formed of a material capable of being cut by said saw blade, and being detachably connected to the remaining portions of said plates, whereby they may be replaced when necessary, and d. guide means operable, as said lower plate is slidably moved over said table, to confine said movement to a line longitudinal to the plates and parallel to the to the plane of said saw blade, with said matching longitudinal plate edges closely adjacent the vertical plane of the adjacent surface of said saw blade.

2. For use in combination with a table saw having a horizontal planar table and a power driven circular saw blade disposed in a vertical plane with its upper portion projecting upwardly through and above a slot of said table, a veneer edging jig comprising:

a. an elongated lower clamp plate adapted to rest slidably on said saw table, and having an upright secured to each end thereof, b. a rod extending longitudinally to said lower plate in parallel, spaced relation thereabove and secured at its ends to said uprights, c. an elongated upper clamp plate disposed above and parallel to said lower plate beneath said rod, said upper plate being provided at each end with a longitudinally projecting tongue, said tongue being slidably engaged in a vertical groove formed therefor in the associated upright, whereby said plates are maintained in longitudinal transverse alignment, d. operating means operable to lower said upper plate forcibly toward said lower plate whereby to clamp veneer sheets therebetween with the portions of of said sheets to be trimmed away projecting outwardly between a pair of matching longitudinal edges of said plates, said operating means including a series of screw nuts carried by said rod at spaced intervals therealong with their axes normally vertical, and an elongated, manually operable screw threaded through each of said nuts with its lower end engaging the top of said upper plate, and e. guide means operable, as said lower plate is slidably moved over said table, to confine said movement to a line longitudinal to said plates and parallel to the plane of said saw blade, with said matching longitudinal plate edges closely adjacent the vertical plane of the adjacent surface of said saw blade.

3. A device as recited in claim 2 with the addition of a sleeve carried rotatably on said rod corresponding to each of said nuts, each nut being affixed to its corresponding sleeve, and wherein said upper plate is provided at its upper surface with a shallow socket member corresponding to each of said screws, the lower end of each screw being removably engaged in its corresponding socket member, whereby by manually retracting each screw slightly upwardly to disengage it from said socket, and turning the corresponding sleeve on said rod, the screw may be pivoted away from vertical to permit unrestricted elevation of said upper plate.

4. A device as recited in claim 3 with the addition of resilient members interconnecting said rod and said upper plate and operable to elevate said upper plate whenever it is not constrained downwardly by said screws.

* * * * *